US007298075B2

(12) United States Patent
Johansson

(10) Patent No.: US 7,298,075 B2
(45) Date of Patent: Nov. 20, 2007

(54) DISCHARGE ELECTRODE FOR USE IN AN ELECTROSTATIC PRECIPITATOR AND METHOD OF MANUFACTURING THE SAME

(75) Inventor: Harry Johansson, Skelleftea (SE)

(73) Assignee: BACT System I Skelleftea AB, Skelleftehamn (SE)

( * ) Notice: Subject to any disclaimer, the term of this patent is extended or adjusted under 35 U.S.C. 154(b) by 62 days.

(21) Appl. No.: 10/496,383

(22) PCT Filed: Nov. 27, 2002

(86) PCT No.: PCT/SE02/02194

§ 371 (c)(1),
(2), (4) Date: May 24, 2004

(87) PCT Pub. No.: WO03/057371

PCT Pub. Date: Jul. 17, 2003

(65) Prior Publication Data

US 2004/0255784 A1 Dec. 23, 2004

(30) Foreign Application Priority Data

Nov. 30, 2001 (SE) ..... 0104042

(51) Int. Cl.
*B03C 3/41* (2006.01)

(52) U.S. Cl. ..... 313/356; 313/335; 313/34; 96/97; 96/95; 250/281

(58) Field of Classification Search ..... 313/335, 313/351, 356, 357, 231.01, 34; 60/275; 96/15, 96/95, 97, 98; 250/281
See application file for complete search history.

(56) References Cited

U.S. PATENT DOCUMENTS

| | | | | | |
|---|---|---|---|---|---|
| 2,505,907 | A | * | 5/1950 | Meston | 313/351 |
| 2,694,464 | A | * | 11/1954 | Wintermute | 96/97 |
| 3,758,810 | A | * | 9/1973 | Seifert | 313/356 |
| 4,126,434 | A | * | 11/1978 | Keiichi | 96/76 |
| 4,138,233 | A | * | 2/1979 | Masuda | 96/82 |
| 4,352,681 | A | * | 10/1982 | Dietz | 96/61 |
| 4,689,951 | A | | 9/1987 | Polach | 60/275 |
| 4,848,986 | A | * | 7/1989 | Leluschko et al. | 96/97 |
| 5,039,318 | A | * | 8/1991 | Johansson | 96/74 |
| 5,125,936 | A | * | 6/1992 | Johansson | 96/84 |

(Continued)

FOREIGN PATENT DOCUMENTS

DE 2904153 8/1980

(Continued)

OTHER PUBLICATIONS

Computer translation of Kanazawa.*

*Primary Examiner*—Mariceli Santiago
*Assistant Examiner*—Peter Macchiarolo
(74) *Attorney, Agent, or Firm*—Mark P. Stone

(57) ABSTRACT

The present invention relates to a discharge electrode (1) for use in an electrostatic precipitator in combination with one or more collecting electrodes, wherein the discharge electrode (1) has the form of a tubular element (2). The discharge electrode (1) includes electrode elements (3) that consist of tongues (4) bent out from the wall (5) of said tubular element, said tongues also be bent upwards. The invention also relates to a method of producing the discharge electrode.

4 Claims, 1 Drawing Sheet

U.S. PATENT DOCUMENTS

| | | | | | |
|---|---|---|---|---|---|
| 5,254,155 | A * | 10/1993 | Mensi | ..... | 96/44 |
| 6,926,758 | B2 * | 8/2005 | Truce | ..... | 95/78 |
| 2005/0028676 | A1 * | 2/2005 | Heckel et al. | ..... | 96/95 |

FOREIGN PATENT DOCUMENTS

| | | | |
|---|---|---|---|
| FR | 2755882 | | 5/1998 |
| JP | 2001158987 | A * | 6/2001 |

* cited by examiner

DISCHARGE ELECTRODE FOR USE IN AN ELECTROSTATIC PRECIPITATOR AND METHOD OF MANUFACTURING THE SAME

BACKGROUND OF THE INVENTION

The present invention relates to a discharge electrode, for use in an electrostatic precipitator.

Electrostatic precipitators are used, for instance to clean dust-laden gases deriving from different types of industrial plants, incinerating plants, and combustion plants.

An electrostatic precipitator also includes so called collecting electrodes, in addition to discharge electrodes. A potential difference is created between the discharge electrodes and the collecting electrodes with the aid of a voltage source, so as to generate an electric field in an area between said electrodes through which the dust-laden gas passes, wherein the dust particles settle on the collecting electrodes, so that the gas will be essentially clean of dust as it exits from the precipitator.

Preferably, D.C. voltage is used with the electrodes to obtain the greatest possible electric field strength at which a glow discharge or corona will be achieved, so as to obtain a maximum separation force on the individual dust particles and thereby achieve the best possible gas cleaning effect.

It is desirable to design the electrode element of the discharge electrode so that the generation of a glow discharge or corona will be stimulated, corrosion will be minimized, and good mechanical stability will be obtained. The design of the electrode element will, conveniently, enable the discharge electrodes to be manufactured and handled in a reasonable manner. It is also desirable that the discharge electrodes will require minimal service and will be highly effective.

BRIEF SUMMARY OF THE INVENTION

An object of the present invention is to provide a discharge electrode with which these desiderata are achieved, said object being realized with a discharge electrode that has the characteristic features set forth in the accompanying claims.

The discharge electrode includes a first tab or tongue bent outwardly from a wall of the tube of the discharge electrode, and a second tab or tongue substantially diametrically opposed to the first tab or tongue and bent inwardly from the wall of the tube. Preferably, the first tab or tongue, which comprises an electrode element, and the second tab or tongue, are punched from the wall of the tube in a single working operation The design and construction of the inventive discharge electrode is such as to impart thereto a high degree of efficiency and also an extremely good resistance to corrosion. The electrode is mechanically stable, simple to install and requires the minimum of maintenance. The discharge electrode affords both technical and economical advantages.

BRIEF DESCRIPTION OF THE SEVERAL VIEWS OF THE DRAWINGS

The invention will now be described in more detail with reference to an exemplifying embodiment thereof and also with reference to the accompanying drawing, in which.

DETAILED DESCRIPTION OF THE INVENTION

Figure 1:
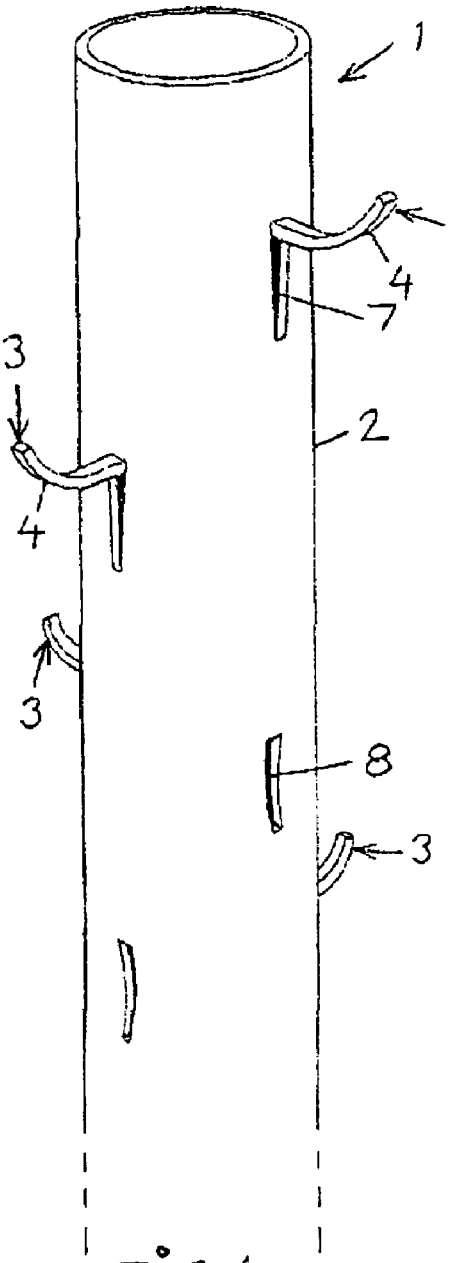
FIG. 1 is a perspective view of an inventive discharge electrode.

The illustrated discharge electrode 1 is constructed from a round tube 2 comprised of an electrically conductive material, for instance, of stainless steel or acid-proof steel, and includes a number of electrode elements or electrode tips 3 that have a corona stimulating function, among other things.

The electrode elements 3 consist in tongues or tabs 4 bent out from the wall of the tube 2. The tongue 4 is punched from the wall 5 of the tube 2 and bent outwards in the manner shown in FIGS. 1 and 2. Since the tab/tongue 4 is bent outwards, the tongue is punched out from inside the tube by using a punch tool 20, meaning that a tab or tongue 6 will also be punched out on diametrically opposed sides of the tube, as will best be seen from FIG. 2. The tongue 6 is bent into the tube 2 and does not therefore constitute an outwardly projecting tongue.

As illustrated in the Figures, the tongues 4 are bent up at their respective tips, so as to ensure that water droplets, e.g. condensation, will not land on the tips of the electrode elements and thereby jeopardize their efficacy. The configuration of the tongues 4 and the sharpness of their edges provide significant advantages from the aspect of corona generation. The configuration of the tongue 4 also minimizes the risk of dust build-up on the electrode elements 3, in accordance with the inventive concept.

Because the tongues/tabs 4 are punched from the tube wall 5, an opening 7 will be left in the wall immediately beneath a respective tongue 4 and a similar opening 8 will be left in the wall 5 beneath the inwardly facing tongue 6.

Figure 2:
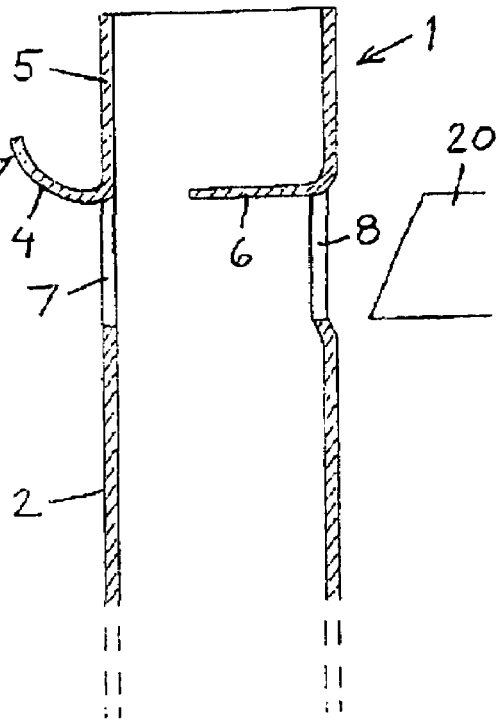
FIG. 2 is a longitudinally sectioned view of the electrode shown in FIG. 1.

The discharge electrode 1 shown in FIG. 1 has a number of electrode elements 3 which point in four mutually different directions. It will be understood, however, that the number of electrode elements provided and their placement on the tube 2 may be varied as desired, in accordance with requirements. The cross-sectional shape of the tube 2 may also be different to that shown, and may, for example, be square instead of round.

It will also be understood that structural modifications are possible within the concept of the invention.

The invention is therefore not restricted to the illustrated and described embodiment thereof, since changes and modifications are possible within the scope of the accompanying claims.

The invention claimed is:

1. A discharge electrode, wherein the discharge electrode (1) is a tube (2), characterised in that the discharge electrode (1) includes electrode elements (3) that include at least one first tab or a tongue (4) bent outwardly from a tube wall (5), and in that the discharge electrode (1) includes at least one second tab or tongue (6) that is bent inwardly from the tube wall (5) and is positioned substantially diametrically opposed to one said first outwardly bent tab or tongue (4), said first outwardly bent tab or tongue (4) is also bent upwards.

2. A method of manufacturing a discharge electrode according to claim 1, characterised by the step of punching through the tube wall (5) in a substantially diametrical orientation with a punch (20) in one single working operation, so as to form said first tab or tongue (4) that bends outwards from the tube wall material, said first tab or tongue (4) comprising one of said electrode elements.

3. A discharge electrode, wherein the discharge electrode (1) is a tube (2), characterised in that the discharge electrode (1) includes electrode elements (3) that include at least one first tab or a tongue (4) bent outwardly from a tube wall (5), and in that the discharge electrode (1) includes at least one second tab or tongue (6) that is bent inwardly from the tube wall (5) and is positioned substantially diametrically opposed to one said first outwardly bent tab or tongue (4), said first outwardly bent tab or tongue (4) is also bent upwards, wherein the tube wall (5) includes an opening (7) associated with each said first outwardly bent tab or tongue (4).

4. A method of manufacturing a discharge electrode according to claim 3, characterised by the step of punching through the tube wall (5) in a substantially diametrical orientation with a punch (20) in one single working operation, so as to form said first tab or tongue (4) that bends outwards from the tube wall material, said first tab or tongue (4) comprising one of said electrode elements.

* * * * *